US006088966A

United States Patent [19]

Kenkel

[11] Patent Number: 6,088,966

[45] Date of Patent: Jul. 18, 2000

[54] HINGE-EMULATING GAP CONCEALING STRIP FOR A DOOR

[75] Inventor: Terry J. Kenkel, Des Moines, Iowa

[73] Assignee: Emco Enterprises, Inc., Des Moines, Iowa

[21] Appl. No.: 09/005,249

[22] Filed: Jan. 9, 1998

Related U.S. Application Data

[63] Continuation-in-part of application No. 08/998,396, Dec. 24, 1997, abandoned.

[51] Int. Cl.[7] ..... E05D 11/00

[52] U.S. Cl. ..... 49/383; 52/204.1

[58] Field of Search ..... 49/383; 52/204.1, 52/716.08; 16/250, 251

[56] References Cited

U.S. PATENT DOCUMENTS

| | | | |
|---|---|---|---|
| 1,494,456 | 5/1924 | Williams | 16/250 |
| 1,683,272 | 9/1928 | Tucker | 16/250 |
| 1,950,443 | 3/1934 | Atwood | 16/250 |
| 2,151,240 | 3/1939 | Soss | 16/251 |
| 2,523,839 | 9/1950 | McKinney | 49/490.1 |
| 2,680,534 | 6/1954 | Pemfold | 16/250 |
| 3,002,592 | 10/1961 | Quinn | 16/250 |
| 3,319,697 | 5/1967 | Krohn | 16/250 |
| 3,422,486 | 1/1969 | Thomas, Jr. | 16/250 |
| 4,344,253 | 8/1982 | Stiles | 49/383 |
| 4,761,852 | 8/1988 | Sauber | 16/237 |
| 5,224,240 | 7/1993 | Smith et al. | 16/251 |
| 5,544,456 | 8/1996 | Dries | 49/383 |

*Primary Examiner*—Daniel P. Stodola
*Assistant Examiner*—Curtis A. Cohen
*Attorney, Agent, or Firm*—Zarley, McKee, Thomte, Voorhees & Sease

[57] ABSTRACT

A hinge-emulating gap concealing strip for a door includes an elongated strip having an length generally corresponding to the length of the hinge assembly. The strip has a generally J-shaped cross-section. The strip includes a straight portion adapted mount on the side edge panel of the door, adjacent the gap that normally exists between a side edge panel and the frame or Z bar attached thereto. The strip has an arcuate portion extending forwarding and outwardly from the straight portion. The arcuate portion extends over the gap so as to form a generally convex arch which protrudes outwardly beyond the exterior panel of the door and resembles the convex arch of the hinge assembly. The straight portion of the strip is attached to the side edge panel. Thus, the hinge-emulating gap concealing the strip spans the gap with a strip that emulates the appearance of the hinge to as to enhance the symmetry of the installed door. Brush strips can also be mounted on the J-shaped strip.

3 Claims, 3 Drawing Sheets

HINGE-EMULATING GAP CONCEALING STRIP FOR A DOOR

CROSS-REFERENCE TO RELATED APPLICATION

This application is a continuation-in-part of application Ser. No. 08/998,396 filed Dec. 24, 1997, now abandoned, under the same title by the same inventor as shown above.

BACKGROUND OF THE INVENTION

The present invention relates to doors. More particularly, this invention relates to storm doors having a hinge side and a handle side wherein a device is useful for concealing the gap which normally exists between the edge of the handle side of the door and the frame adjacent the door. The device of this invention spans the gap with a strip that emulates the appearance of the hinge so as enhance the symmetry of the installed door. As a result, the gap is also protected from frontal drafts coming from the exterior.

Some conventional doors are pivotally mounted to a door frame by one or more hinges. Gaps exist on all sides of the pivotally mounted door, including along the hinge side of the door. The side of the door which is opposite the hinge is generally referred to as the handle side because a handle is usually mounted thereon. As conventionally installed, a significant gap normally exists between the handle side of the door and the frame surrounding the door. This gap is unsightly and allows air or moisture to easily pass through the door opening.

Therefore, a primary object of the present invention is the provision of a device for concealing the gap between the handle side of a door and the adjacent frame.

A further object of the present invention is the provision of a gap concealing device which diverts air or moisture which flows directly toward the exterior front of the door and the handle side gap.

A further object of the present invention is the provision of a gap concealing device which includes an elongated strip that attaches, fastens or screws onto the edge of the door.

A further object of the present invention is the provision of a gap concealing device which emulates the appearance of the hinge assembly and thereby enhances the symmetry of the door.

These and other objects will be apparent from the drawings, the description and claims which follow.

SUMMARY OF THE INVENTION

The present invention relates to a hinge-emulating gap concealing strip for a door. The device includes an elongated strip having a length generally corresponding to the length of the hinge assembly. The strip has a generally J-shaped cross-section. The strip includes a straight portion adapted to mount on the side edge wall of the door, adjacent the gap which normally exists between the side edge wall and the frame or Z bar attached thereto. The strip has an arcuate portion extending forwardly and outwardly from the straight portion. The arcuate portion extends completely cross the gap so as to form a generally convex arch which protrudes outwardly beyond the door and resembles the convex arch of the hinge assembly.

The straight portion of the strip attaches to the side edge wall, preferably with fasteners such as screws. Thus, the device spans the gap with a strip that emulates the appearance of the hinge so as to enhance the symmetry of the installed door. Brush strips can also be mounted on the J-shaped strip.

DETAILED DESCRIPTION OF THE PREFERRED EMBODIMENT

Figure 1:
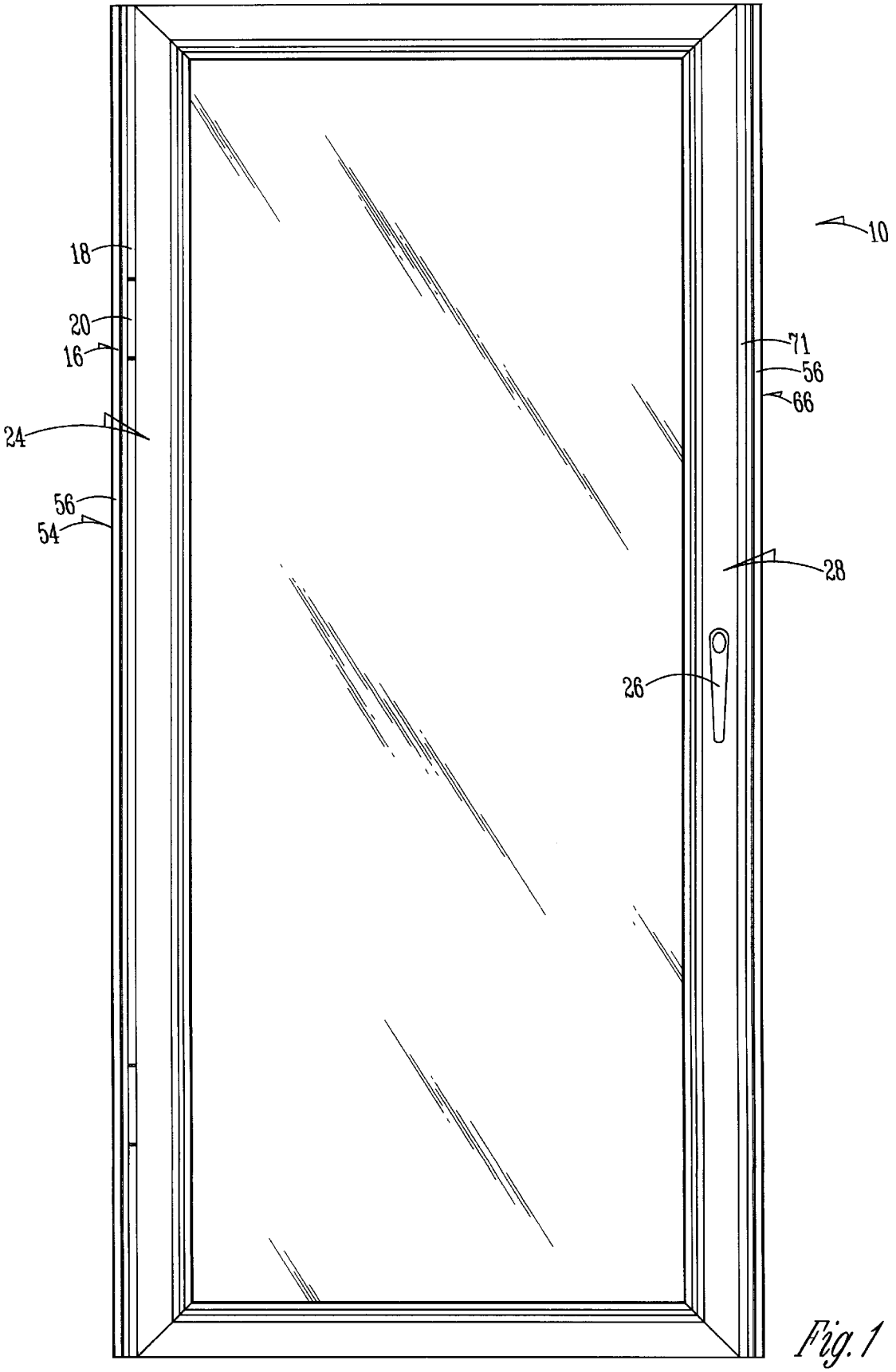
FIG. 1 is a perspective view of a door equipped with the gap concealing device of the present invention and ready for installation in a frame.

FIG. 1 illustrates a door 10 equipped with the gap concealing device of the present invention. The door 10 is pivotally mountable to a frame by a vertically elongated hinge assembly 16. Preferably the hinge assembly 16 is of the butt hinge type. The hinge assembly 16 includes a plurality of mating tubular sleeve members 18, 20 mountable on the door 10 and the frame 14 (FIG. 2), respectively. A hinge pin 22 (FIG. 2) extends through the aligned tubular sleeves 18, 20 to pivotally connect the door 10 to the frame 14. The visible portions of the tubular sleeve members 18, 20 generally form an elongated convex arch portion which protrudes from and extends along the hinge side of the door 10. Thus, the left hand side of the door as viewed in FIG. 1 is generally referred to as the hinge side 24. Because a handle 26 is generally included on the side opposite the hinge assembly 16, that side is referred to as the handle side 28 of the door 10.

Figure 2:
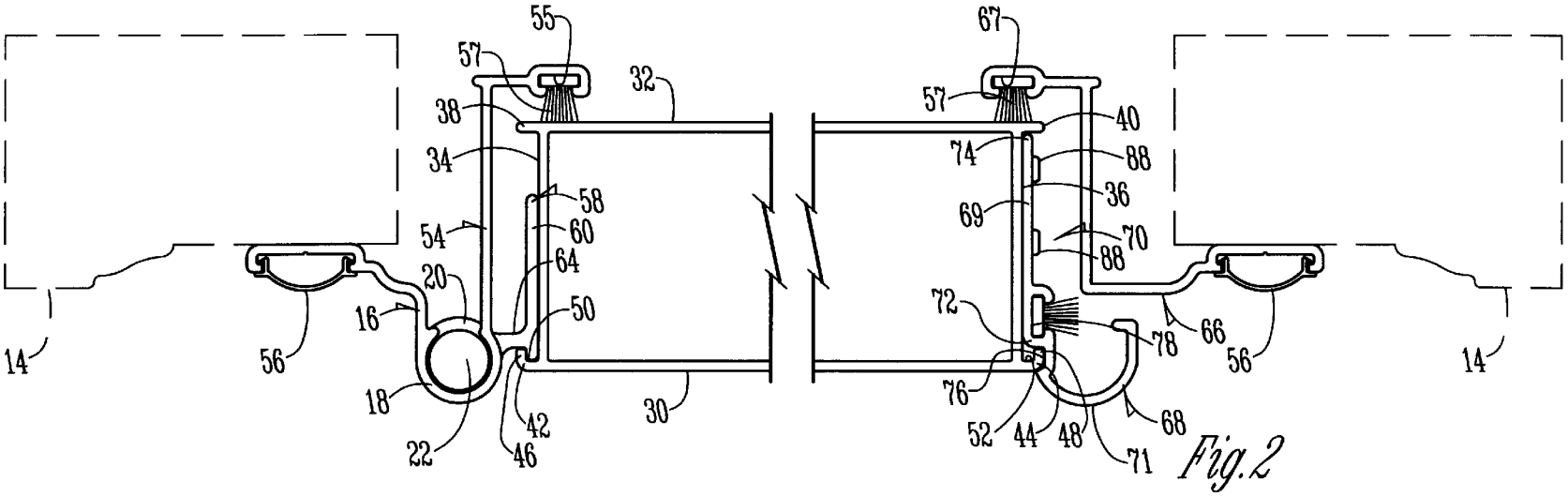
FIG. 2 is an enlarged top view of the door of FIG. 1, mounted in a frame.

As best seen in FIG. 2, the door 10 includes an extruded frame with an exterior wall 30 and an interior wall 32. The extruded frame further includes side edge walls 34, 36 extending between the interior and exterior walls 30, 32.

Vertically elongated lips 38, 40 protrude laterally along the hinge side 24 and the handle side 28 of the interior wall 32. In other words, the lips 38, 40 also protrude outwardly from the side edge walls 34, 36, respectively. The exterior wall 30 includes similar lips 42, 44. However, the lips 42, 44 have curved portions 46, 48, respectively, which turn toward the interior and spaced apart from the respective side edge walls 34, 36 so that the profile of the extruded door forms a track or channel 50, 52.

The hinge assembly 16 includes a Z bar 54 which is mounted to the door frame 12 in a conventional manner. The conventional fasteners (not shown) for attaching the Z bar 54 to the frame 14 are covered by a resilient cover strip 56 attached to the Z bar 54. A brush strip 58 is attached to the Z bar 54 adjacent the hinge side of the interior wall 32. The Z bar 54 extends vertically along the hinge side 24 of the door 10. At various intervals along the length of the Z bar 54, a hinge member 58 is interposed. The hinge member 58 has a leaf portion 60 and a tubular sleeve portion 20 which are interconnected by a web 64. One or more hinge pins 22 (FIG. 2) are used to pivotally join the tubular portion 20 of the hinge member 58 to the Z bar 54.

Moving to the handle side 28 of the door 10, a second Z bar 66 is fastened to the door frame 14 in a conventional manner. A resilient cover strip 56 is attached to the exterior portion of the Z bar 66. A brush strip 57 is mounted in a slot 67 on the Z bar 66 adjacent the interior wall 32 in the closed position of the door.

Figure 3:
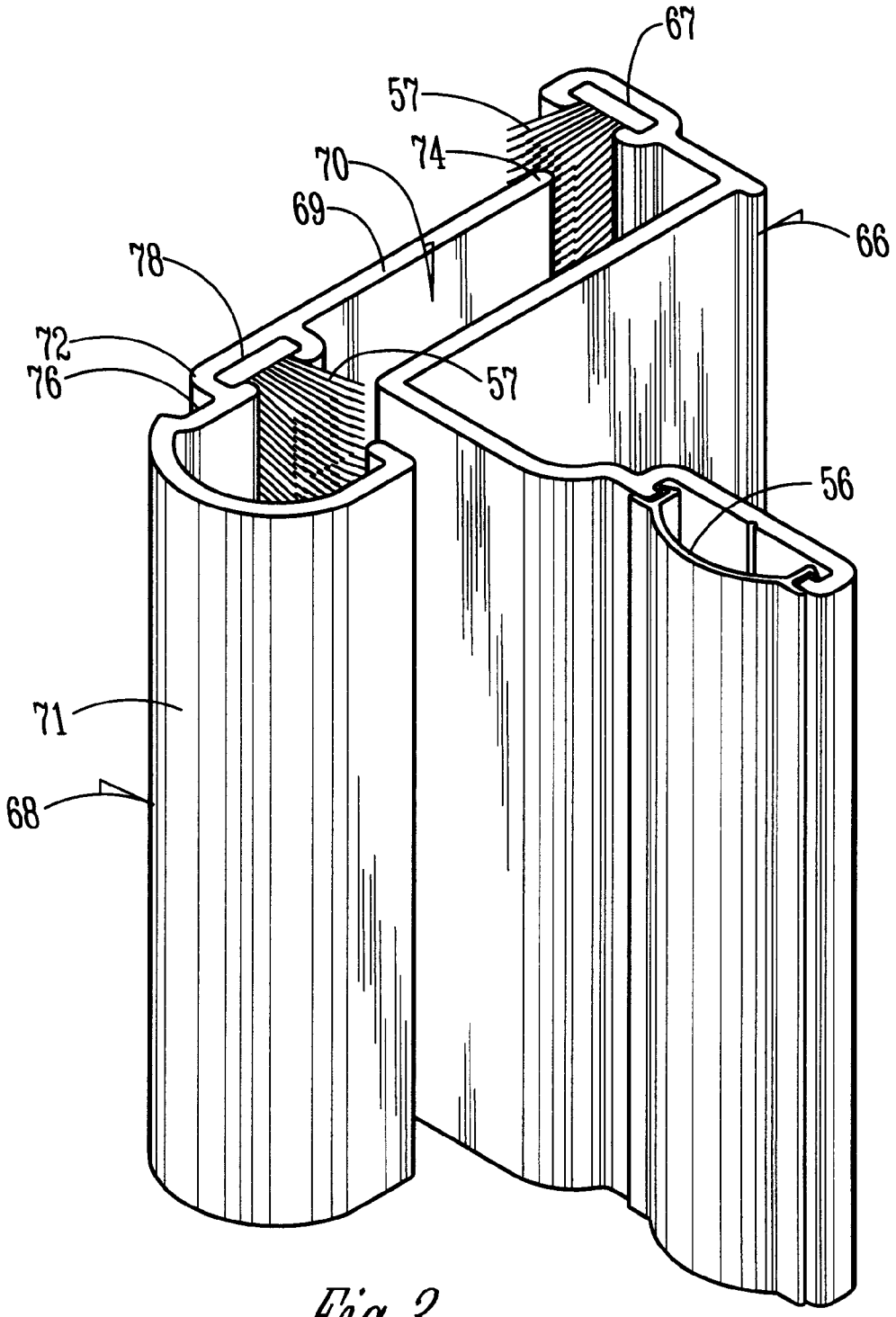
FIG. 3 is a partial enlarged frontal perspective view of the gap concealing device of FIGS. 1 and 2.

As best seen in FIGS. 2 and 3, an elongated J-shaped strip 68 having a length generally corresponding to the length of the hinge assembly 16 is mounted on the side edge wall 36. The strip 68 has an elongated straight portion 69 adapted to mount on the side edge wall 36 adjacent the handle side 28.

The strip 68 has an arcuate portion 71 extending forwardly and outwardly from the straight portion 69. The arcuate portion 71 extends completely across a gap 70, which normally exists between the Z bar 66 and the side edge wall 36. The arcuate portion 71 forms a generally convex arch which protrudes outwardly beyond the exterior wall 30 of the door 10. The J-shaped strip 68 has a finite thickness which is substantially less than the thickness of the gap 70. The strip 68 extends vertically along the handle side 28 of the door 10. Thus, the arcuate portion 71 closely resembles the convex arch of the tubular sleeve members 18, 20 of the hinge assembly 16 when the exterior of the door is viewed from the exterior.

The straight portion 69 of the strip 68 has opposite ends 72, 74 which extend toward the exterior and interior walls 30, 32, respectively. The straight portion 69 attaches to the side edge wall 36. The lips 40, 44 extend outwardly from the interior and exterior walls (32, 30) respectively. The lip 44 fits into a groove 76 adjacent the arcuate portion 71. The straight portion 69 of the strip 68 also includes an elongated T-shaped slot 78 which slidably receives a brush strip 57. This brush strip 57 extends outwardly across the gap 70 in the generally direction of the Z bar 66. The free end of the arcuate portion 71 is turned inwardly toward the straight portion 69. Thus, the strip 68 emulates the hinge assembly 16 while concealing the gap 70.

In use, the J-shaped strip 68 is attached to the handle side of the door 10 in the position shown in FIG. 2. Conventional means of attachment including fasteners, such as screws, rivets, or even adhesives can be used to secure the strip 68 to the side edge wall 36. In the preferred embodiment, screws 88 are the means of attachment. The strip 68 prevents the direct frontal entry of air or moisture through the gap 70. Furthermore, it can be seen that the strip of this invention enhances the symmetry of the door assembly and conceals the gap.

Therefore, it can be seen that the present invention at least accomplishes the stated objectives.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. In combination, a door having spaced apart and opposing first and second peripheral side edges with the first peripheral side edge being pivotally mounted to a frame by a hinge assembly having a tubular hinge sleeve constituting an exposed convex arch portion, the frame and the second peripheral side edge of the door defining an elongated gap therebetween, and a gap concealing device, comprising:

an elongated strip mounted to the second peripheral side edge of the door adjacent the gap, the strip having a length generally corresponding to the length of the hinge assembly and having a generally J-shaped cross-section;

the strip having a substantially straight portion mounted to the second peripheral side edge of the door and an arcuate portion extending forwardly and outwardly from the straight portion and forming a generally convex arch which protrudes outwardly beyond the second peripheral side edge of the door, extends over the gap, and resembles the convex arch portion of the hinge assembly.

2. The combination of claim 1 wherein the hinge assembly is a butt hinge assembly.

3. The strip of claim 1 wherein the strip is extruded as a single piece.

* * * * *